US008061175B2

(12) United States Patent
Franze

(10) Patent No.: US 8,061,175 B2
(45) Date of Patent: Nov. 22, 2011

(54) SHEET-METAL BENDING MACHINE, PREFERENTIALLY HYDRO-POWERED MACHINE, AND A METHOD OF ITS OPERATION

(76) Inventor: Reinhard Franze, Wals-Sitzenheim (AT)

( * ) Notice: Subject to any disclaimer, the term of this patent is extended or adjusted under 35 U.S.C. 154(b) by 625 days.

(21) Appl. No.: 12/172,294

(22) Filed: Jul. 14, 2008

(65) Prior Publication Data

US 2009/0013748 A1 Jan. 15, 2009

(30) Foreign Application Priority Data

Jul. 13, 2007 (CZ) ..... 2007-472

(51) Int. Cl.
*B21D 11/00* (2006.01)
*B21D 31/00* (2006.01)
*B21D 37/12* (2006.01)

(52) U.S. Cl. ..... 72/312; 72/389.1; 72/455

(58) Field of Classification Search ..... 72/31.11, 72/306, 308, 309, 311–316, 319–323, 389.1, 72/389.6, 420, 422, 450, 451, 453.01, 453.02, 72/455, 460; 100/231, 269.17, 269.2
See application file for complete search history.

(56) References Cited

U.S. PATENT DOCUMENTS

| | | | | |
|---|---|---|---|---|
| 4,043,165 | A | 8/1977 | Badger et al. | |
| 4,843,862 | A * | 7/1989 | Salvagnini | 72/319 |
| 5,123,270 | A | 6/1992 | Salvagnini | |
| 5,647,243 | A * | 7/1997 | Zampini | 72/312 |
| 5,765,427 | A | 6/1998 | Codatto | |
| 6,640,600 | B2 * | 11/2003 | Meinert | 72/306 |

FOREIGN PATENT DOCUMENTS

| | | |
|---|---|---|
| EP | 0920931 | 6/1999 |
| EP | 1064110 | 1/2001 |
| EP | 1854564 | 11/2007 |
| WO | WO 93/16822 | 9/1993 |
| WO | WO 96/04084 | 2/1996 |

* cited by examiner

*Primary Examiner* — Teresa Ekiert
(74) *Attorney, Agent, or Firm* — Notaro, Michalos & Zaccaria P.C.

(57) ABSTRACT

The invention deals with a sheet-metal bending machine containing a lower machine part and an upper machine part mounted on it in a movable way where on either of the upper and lower machine part there is a pair of working tools designed as a bending arm and a holding arm where the principle is that the upper machine part (3), or at least the pair of the working tools connected to it, is, in relation to the lower machine part (2), or at least in relation to the pair of the working tools connected to it in the feeding direction (L) of the processed metal sheet (14), mounted in a mutually horizontally sliding bond.

21 Claims, 6 Drawing Sheets

SHEET-METAL BENDING MACHINE, PREFERENTIALLY HYDRO-POWERED MACHINE, AND A METHOD OF ITS OPERATION

TECHNICAL FIELD

The invention deals with sheet-metal bending machines containing a lower fixed part and a movable upper part over the lower part while on either of the parts there is a movable bending device and a fixed holding device.

BACKGROUND ART

At present, sheet-metal bending machines are known that bend sheets in various directions while during the bending the processed object does not have to rotate between individual bending steps. For this purpose in the existing machines the sheet-metal is clamped between the upper and lower holding arm and being clamped this way it is bent or folded either from the top by the upper bending device or arm or from the bottom by the lower bending device or arm. A disadvantage of the operation of the machines of this type consists in the fact that until the moment of bending the inactive bending arm must be away from the bending space, which is achieved by turning or shifting of the arm that is inactive at the particular moment, e.g. with the use of a hydraulic cylinder. In such a situation it is necessary to achieve the corresponding wider turning or shifting movement if the remaining range of movement at that moment should not be limited. On the basis of the described state of the art the purpose of the invention appears to be the creation of a sheet-metal bending machine that would have a simple structure and at the same time enable bending in a large angular range and where it would be possible to carry out a quick change of the machine adjustment or its re-adjustment to bending in a different direction than in the previous bending step.

DISCLOSURE OF THE INVENTION

The disadvantages of the hitherto bending machines are reduced and the purposes of the invention, i.e. creation of a simple machine for a large range of movement and easy re-adjustment for bending in a different direction, are achieved in the sheet-metal bending machine in accordance with the present invention where the bending machine contains the lower machine part and the upper machine part mounted on the lower part in a movable way and where on either of the upper and lower machine part there is a pair of working tools designed as a bending arm and a holding arm and where the principle is that the upper machine part, or at least the pair of the working tools connected to it, is, in relation to the lower machine part, or at least the pair of working tools connected to it, mounted in the mutually horizontally sliding bond.

It is advantageous if the mutually horizontally sliding bond is designed in such a way that the range of the mutual shift between the upper pair of the working tools and the lower pair of the working tools is equal to twice the length of the bearing surface of the bending arm, measured in the feeding direction of the processed sheet-metal. The mutual horizontal sliding bond of the upper machine part, or at least the pair of working tools connected to it, is, in relation to the lower machine part or at least the pair of working tools connected to it, beneficially hydro-powered, i.e. it is equipped with a machine drive, equipped with the first hydraulic motor. A mutual horizontal shift of the upper machine part with regard to the lower machine part, or at least an analogous shift of the upper pair of the working tools with regard to the lower pair of the working tools, or vice versa, namely on the level of the holding arm represents a simple way of re-adjustment of the bending edge for the next bending step. Advantageously, the upper machine part is mounted in a sliding way as compared to the lower machine part in the feeding direction of the processed sheet. Alternatively, it is advantageous if the lower pair of the working tools, consisting of the lower bending arm and the lower holding arm, is mounted in a horizontally sliding way with regard to the upper machine part in the direction of the processed sheet. It is further beneficial if the upper machine part and the lower machine part are designed for mutual separation, at least in the contact area of their working tools. Such separation is necessary for free handling of the processed sheet. The mechanism of mutual separation of the upper and lower machine part of the sheet-metal bending machine is beneficially equipped with a drive mechanism containing the second hydraulic motor. The system of mutual separation of the upper machine part and the lower machine part is advantageously designed in such a way that the upper machine part is mounted in a swinging way with regard to the lower machine part. The swinging mounting is beneficially designed in such a way that the upper machine part is, with regard to the lower machine part, mounted with the horizontal rotation axis lying on the holding level of the processed sheet. In the case of swinging mounting of the upper machine part, with regard to the lower machine part, it is advantageous if the mounting of the upper machine part, mounted rotationally with regard to the lower machine part, is designed to achieve the opening angle between the upper machine part and the lower machine part of at least 30°. A smaller opening angle would not provide a sufficient space for metal sheet handling in most practical cases of sheet-metal bending, especially during bending or turning and removing sheets from the machine. For most practical applications or most dimensions and bending angles of processed sheets it is beneficial if the upper machine part, mounted rotationally with regard to the lower machine part, has its mounting designed in such a way to achieve the opening angle between the upper machine part and the lower machine part in the range from 60° to 90°. However, the design where the mounting is adapted to achieve the opening angle between the upper machine part and the lower machine part in the range from 70° to 85° appears to be the most beneficial. On the one hand this angular range will sufficiently enable adequate handling of metal sheets in the present bending machine in most common alternatives of shaping of processed sheets and on the other hand the opening mechanism of the machine parts will not be too complex and also the overall spatial demands for machine installation will not be unacceptably high due to extreme movement ranges of the machine. The system of mutual separation of the upper machine part and the lower machine part is alternatively beneficially designed in such a way that the upper machine part is mounted in a vertically sliding way with regard to the lower machine part, namely in parallel guiding. In the case of the vertically sliding mounting of the upper machine part with regard to the lower machine part it is advantageous if the vertically sliding mounting of the upper part with regard to the lower part is designed to achieve the opening width between the upper machine part and the lower machine part of at least 200 mm. Smaller opening widths would not provide a sufficient space for sheet-metal handling in most practical cases, especially during bending or turning and removing sheets from the machine. For most practical applications or most dimensions and bending angles of processed sheets it is beneficial if the upper machine part, mounted in a vertically sliding way with regard to the lower machine part, has its mounting designed in such a way to achieve the opening width between the upper machine part and the lower machine part in the range from 500 to 1200 mm. However, the design where the mounting is adapted to achieve the opening width between the upper machine part and the lower machine part in the range from 500 to 1000 mm appears to be the most beneficial. On the one hand this width range will sufficiently enable adequate handling of metal sheets in the present bending machine in most common alternatives of shaping of processed sheets and on the other hand the opening mechanism of the machine parts will not be too complex and also the overall spatial demands for machine installation will not be unacceptably high due to extreme movement ranges of the machine. It is further beneficial if at least one of the bending arms is connected to the corresponding holding arm with an articulated movement mechanism. It is especially beneficial if both the bending arms are connected to the holding arm with the articulated movement mechanism. With the mounting of the bending arm, in relation to the holding arm via an articulated mechanism, it is possible to achieve such a suspension where the bending arm can turn around a straight line lying near the bending edge of the processed sheet and where the actual physically created axis for suspension of the bending arm on the holding arm does not have to lie on this straight line. Generally, it would be possible to physically create such an axis as a pair of axes along the side of the bending edge on the supporting surface for the processed sheet, but a disadvantage of such a structure consists in the fact that the bending arm, or its acting element designed as a bending strip suspended at the sides, will not be sufficiently rigid in the central part between its suspensions and with such a structure it is not possible to laterally add other segments for extension of the machine if there is a requirement to bend wider sheets. The articulated movement mechanisms of the bending arms are advantageously driven by the third hydraulic motor. These as well as the previous mechanisms can also be directly driven by e.g. electric motors, but the use of hydraulic motors appears to be optimum with regard to their life, reliability and the possibility to achieve high driving forces at sufficiently precise control of the forces and shifts required for sheet-metal bending machines of the present design. It is also beneficial if the connection of at least one of the bending arms to the corresponding holding arm with the use of the articulated movement mechanism is designed in such a way that in the situation of holding clamping the angle between the clamping plane and the front side of the bending arm is higher than 115°. It is especially beneficial if, in the situation of holding clamping, the angle between the clamping plane and the front side of the bending arm is in the range from 125° to 150°.

Another object of the present invention is a method of operation of the sheet-metal bending machine designed in accordance with the present invention, where the processed metal-sheet part is clamped between a holding arm and the opposite, in this stage fixed arm, and the part of the processed sheet-metal exceeding the bending edge is subsequently bent, while the principle is that the bending is done with the use of the bending arm suspended via an articulated movement mechanism on the clamping arm while during the bending of the processed metal part by the upper bending arm the opposite arm is represented by the lower bending arm and during bending of the processed metal part by the lower bending arm the opposite arm is represented by the upper bending arm.

The present structure, including the related method of its operation, provides a sheet-metal bending machine, preferentially with a hydraulic drive, that can process even relatively large sheets with a relatively demanding bending plan while the created machine is quite simple and moreover it makes it possible to achieve a large angular range of bending and ensures good handling of the sheets during the whole bending process.

BRIEF DESCRIPTION OF THE DRAWINGS

The present invention is further described and explained in a more detailed way with the use of a sample embodiment and attached drawings, where always in the side view

FIGS. 6*a*, 6*b* and 6*c* present different consecutive positions of the processing tools in the situation in the first bending step while

BEST MODES FOR CARRYING OUT THE INVENTION

Figure 1:
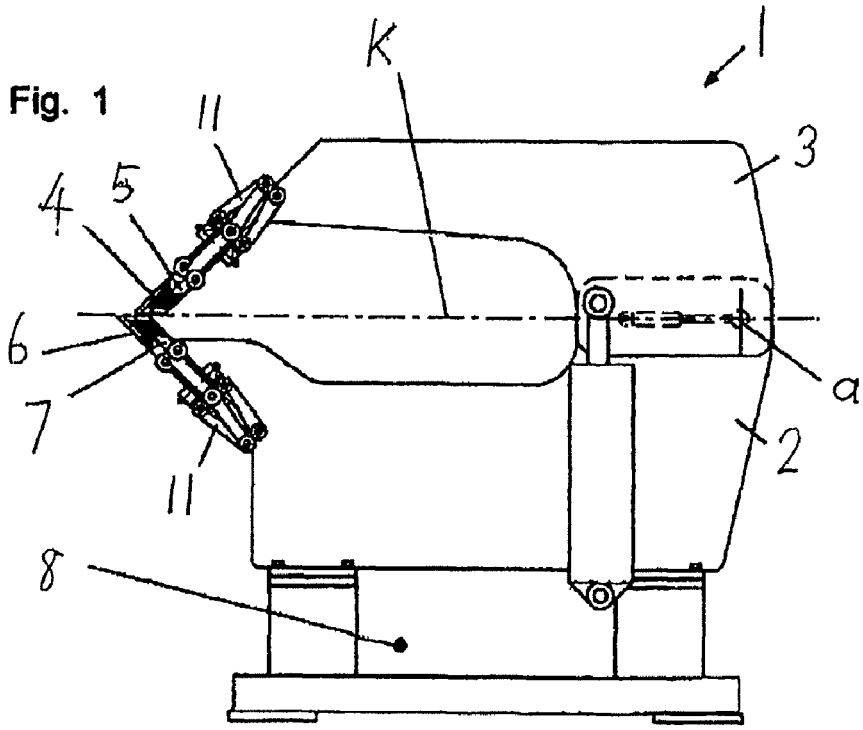
FIG. 1 shows the sheet bending machine in the first closed position.
Figure 2:
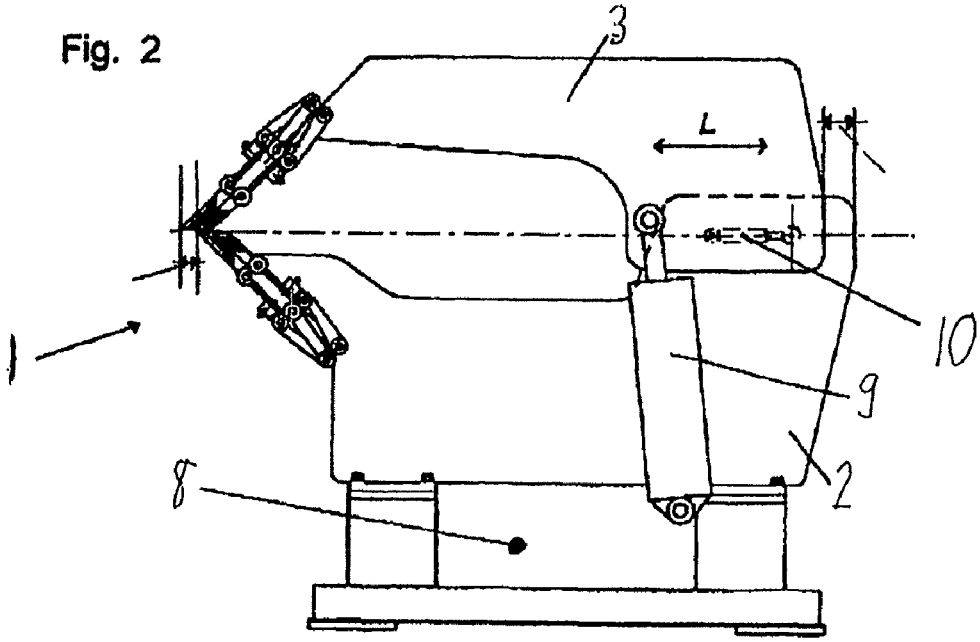
FIG. 2 shows the same bending machine in the second closed position, FIG. 3 displays the same bending machine, this time with the upper machine part in the open position, further
Figure 3:
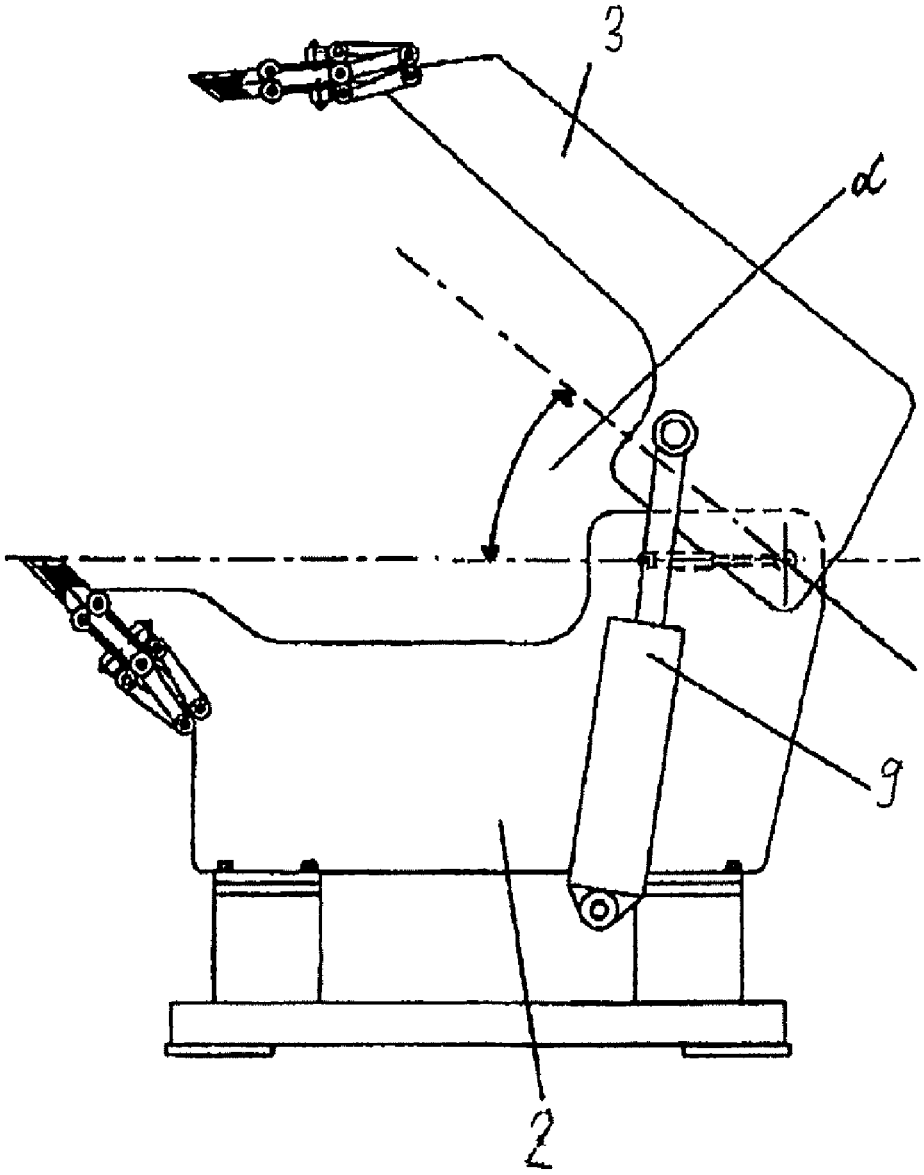
Figure 4A:
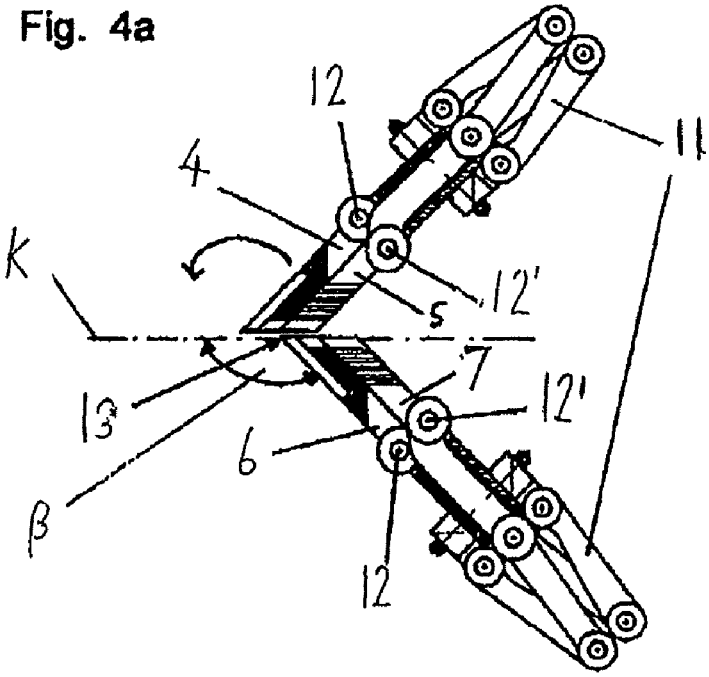
FIGS. 4*a* and 4*b* show details of various positions of the processing tools in the mutual position related to the display of the whole bending machine in FIG. 1 or FIG. 2 respectively.
Figure 4B:
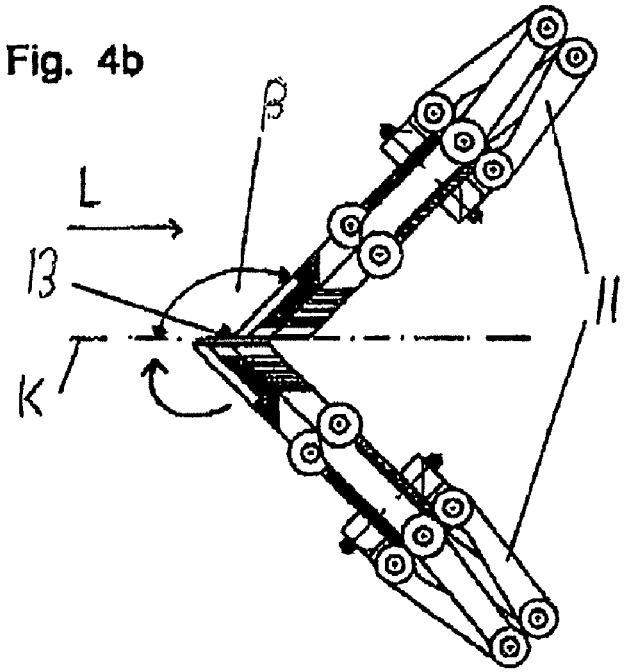
Figure 5:
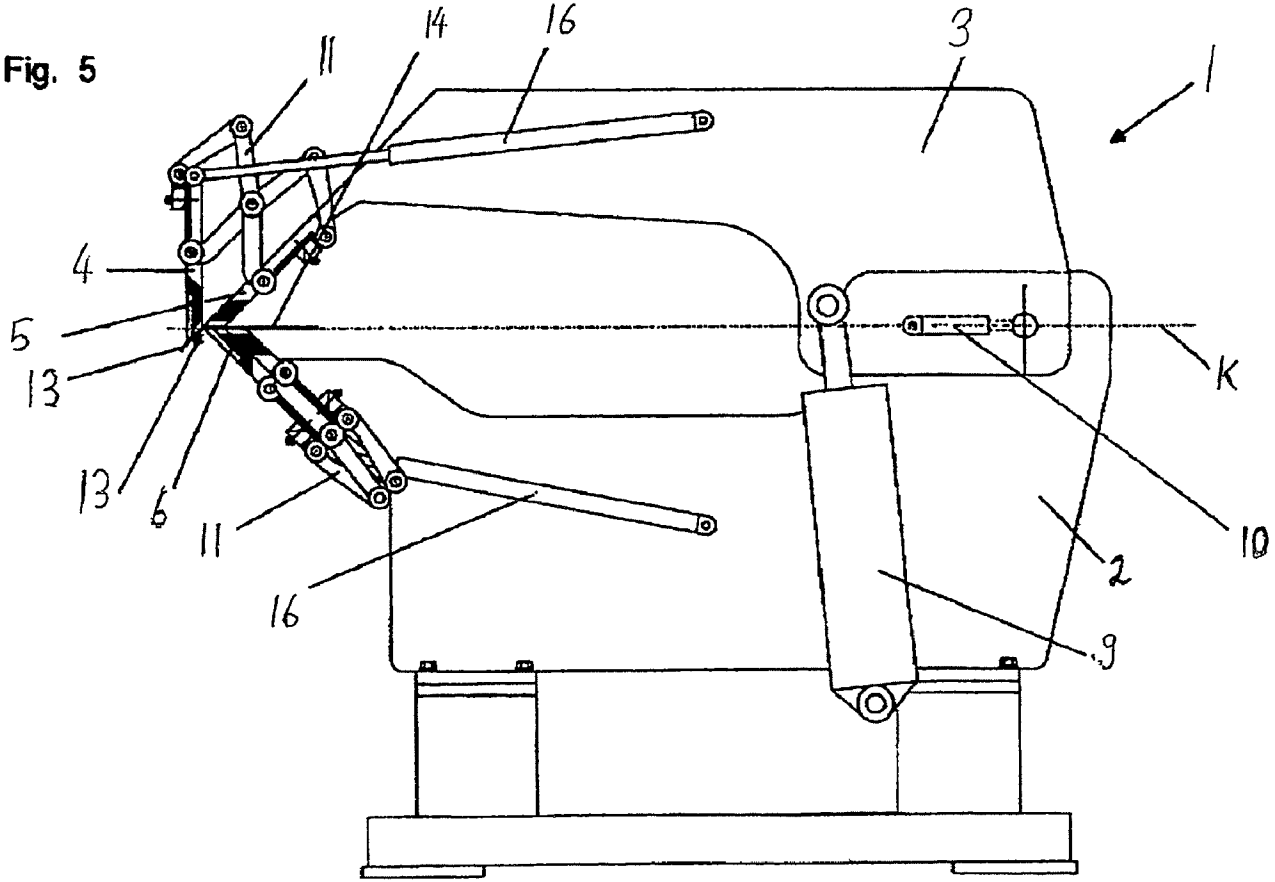
FIG. 5 shows the whole bending machine with the upper bending arm in the turned position while further
Figure 6A:
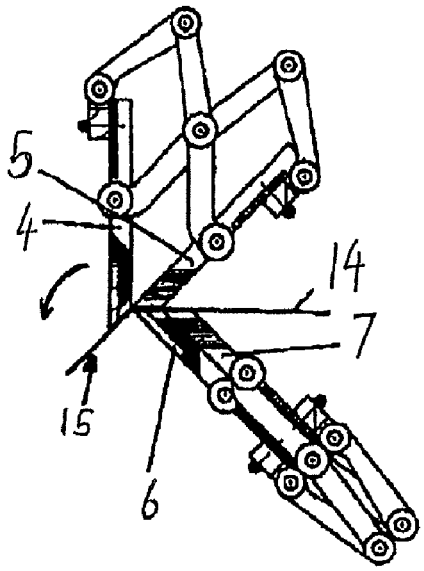
Figure 6B:
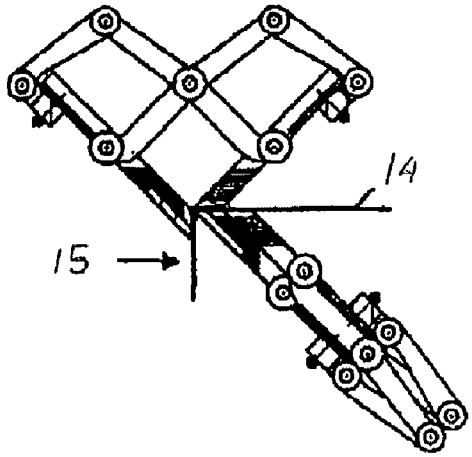
Figure 6C:
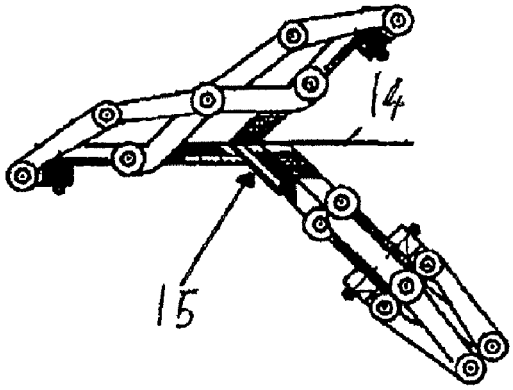
Figure 7A:
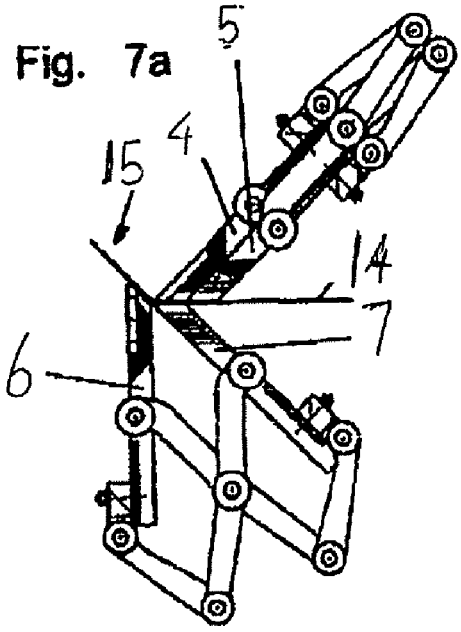
FIGS. 7*a*, 7*b* and 7*c* show different consecutive positions of the processing tools in the situation in the second bending step.
Figure 7B:
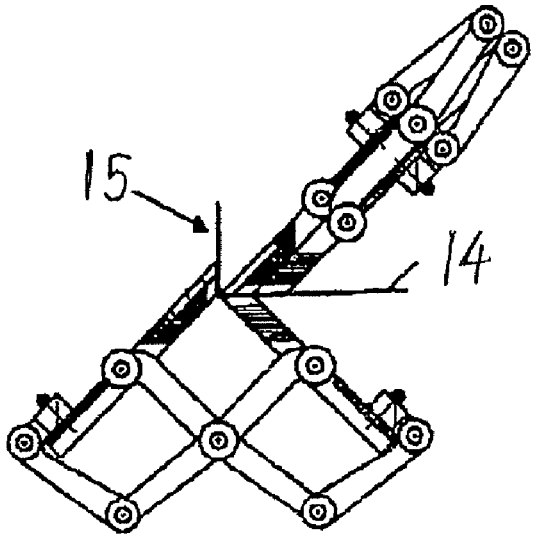
Figure 7C:
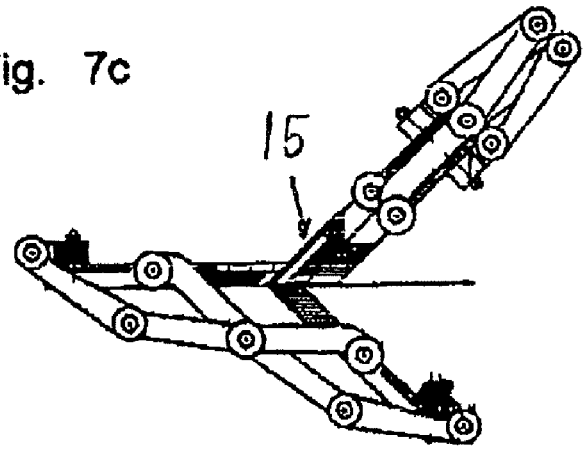

The sample embodiment of the invention presents a sheet-metal bending machine designed in accordance with the present invention, namely in a version where the upper machine part is suspended rotationally on the lower machine part. The other basic alternative, where the upper machine part can be separated from the lower machine part in a parallel position by shifting in a guide in the vertical direction is not shown here. This other alternative appears to be a little more complicated from the structural point of view, but as regards the effect, it is as functional as the first basic alternative. The presented sample embodiment represents, within the first basic alternative, its version where the mutual horizontal shift of the processing tools is achieved through sliding mounting of the upper machine part in the lower machine part.

Thus, in the presented sample embodiment, the bending machine 1 contains the lower machine part 2 and the upper machine part 3 mounted on it in a movable way. On either of the upper and the lower machine part 3, 2 there is always a pair of working tools designed as a bending arm 4, 6 and a holding arm 5, 7. What is important is that the upper machine part 3 is mounted in relation to the lower machine part 2 in the feeding direction L of the processed sheet-metal 14 in a mutually horizontally sliding bond. The whole machine, i.e. the bending machine 1 is installed on a machine foundation 8, mounted or fixed to the ground. In this version the mutually horizontally sliding bond is beneficially designed in such a way that the range of mutual shift S between the upper pair of the working tools 4, 5 and the lower pair of the working tools 6, 7 is equal to twice the length b of the bearing surface of the bending arm 4, 6, measured in the feeding direction L of the processed sheet-metal 14. The mutual horizontally sliding bond of the upper machine part 3 with regard to the lower machine part 2 designed in the feeding direction L of the processed sheet-metal 14 is equipped with a machine drive here containing the first hydraulic motor 10. A mutual horizontal shift of the upper machine part 3 with regard to the lower machine part 2 on the level of the holding arm 5, 7 represents a simple way of re-adjustment of the bending edge 13 for the next bending step. Further, the upper machine part 3 and the lower machine part 2 are adapted for mutual separation, mainly in the contact area of their working tools 4, 5, 6, 7. This separation is necessary for free handling of the processed sheet-metal 14. The mechanism of the mutual separation of the upper and lower machine part 3, 2 of the sheet-metal bending machine is equipped with a drive system containing the second hydraulic motor 9. The system of mutual separation of the upper machine part 3 and the lower machine part 2 is designed in such a way that the upper machine part 3 is mounted in a swinging way with regard to the lower machine part 2. The swinging mounting is designed in such a way that the upper machine part 3 is mounted with regard to the lower machine part 2 with the horizontal turning axis a lying on the clamping plane K of the processed sheet-metal 14. The mounting of the machine part 3, mounted rotationally with regard to the lower machine part 2, is adapted to achieve the opening angle $\alpha$ between the upper machine part and the lower machine part corresponding to 70°. On the one hand this angular range will sufficiently enable adequate handling of sheets in the present bending machine in most common alternatives of shaping of processed sheets and on the other hand the opening mechanism of the machine parts will not be too complex and also the overall spatial demands for machine installation will not be unacceptably high due to extreme movement ranges of the machine. Both the bending arms 4, 6 are connected to the corresponding holding arm 5, 7 with the use of an articulated movement mechanism 11 where individual parts are connected with joints 12, 12'. With the mounting of the bending arm 4, 6 in relation to the holding 5, 7 arm via the articulated mechanism 11 it is possible to achieve such a suspension where the bending arm 4, 6 can turn around a straight line lying near the bending edge 13 of the sheet-metal 14 and where the actual physically created axis for suspension of the bending arm 4, 6 on the holding arm 5, 7 does not have to lie on this straight line. Generally, it would be possible to physically create such an axis as a pair of axes along the side of the bending edge 13 on the supporting surface for the processed sheet-metal 14, but a disadvantage of such a structure consists in the fact that the bending arm, or its acting element designed as a bending strip suspended at the sides, will not be sufficiently rigid in the central part between its suspensions and with such a structure it is not possible to laterally add other segments for extension of the machine if there is a requirement to bend wider sheets. The drive of the articulated movement mechanisms 11 of the bending arms 4, 6 is beneficially ensured here with the third hydraulic motor 16. The connection of the bending arms 4, 6 to the corresponding holding arm 5, 7 with the use of the articulated movement mechanism 11 is adapted in such a way that in the situation of holding clamping the angle $\beta$ between the clamping plane K and the front side of the bending arm 4, 6 is equal to the value of 135°.

The function of the machine is as follows: The processed sheet-metal 14 is clamped between the holding arm 4, or 6 and the opposite, in this stage fixed arm 5, or 7 while the part 15 of the processed sheet-metal 14 exceeding the bending edge 13 is bent while, what is important is that the bending is done with the use of the bending arm 4, 6 suspended via the articulated movement mechanism 11 on the holding arm 5, 7 while during the bending of the processed sheet-metal 14 by the upper bending arm 4 the opposite arm is represented by the lower bending arm 6 and during the bending of the processed sheet-metal 14 by the lower bending arm 6 the opposite arm is represented by the upper bending arm 4.

The present structure provides a hydro-powered sheet-metal bending machine with a hydraulic drive using hydraulic motors, that can process even relatively large sheets of metal with a relatively demanding bending plan while the created machine is quite simple and moreover it makes it possible to achieve a large angular range of bending and ensures good handling of the metal sheets during the whole bending process.

INDUSTRIAL APPLICABILITY

Equipment based on the present invention can be used for bending sheet-metal, namely in situations where the simplest possible structure of the bending machine is required, which should on the other hand be able to process relatively large semi-finished products, even for products with a relatively complex bending plan, all in a temporally and spatially economic mode.

The invention claimed is:

1. A sheet-metal bending machine containing a lower machine part and an upper machine part mounted on it in a movable way where the upper machine part includes an upper pair of working tools having a bending arm and a holding arm and the lower machine part includes a lower pair of working tools having a bending arm and a holding arm, wherein the upper machine part or at least the upper pair of working tools connected to it, is, mounted in relation to the lower machine part, or at least in relation to the lower pair of working tools connected to it, in a feeding direction of the sheet-metal, in a mutually horizontally sliding bond characterized in that at least the bending arm of the upper pair of working tools is connected to the corresponding holding arm by an articulated movement mechanism or the bending arm of the lower pair of working tools is connected to the corresponding holding arm by an articulated movement mechanism.

2. The sheet-metal bending machine according to claim 1, characterized in that the mutually horizontally sliding bond between the upper machine part and the lower machine part is designed in such a way that a range of the mutual shift between the upper pair of the working tools and the lower pair of the working tools is equal to twice the length of a bearing surface of the bending arm, measured in the feeding direction of the sheet-metal.

3. The sheet-metal bending machine according to claim 1, characterized in that the mutually horizontally sliding bond of the upper machine part, or at least of the pair of working tools connected to it, in relation to the location of the lower machine part or at least in relation to the location of the pair of the working tools connected to it, created in the feeding direction of the sheet-metal, is equipped with a machine drive containing a hydraulic motor.

4. The sheet-metal bending machine according to claim 1, characterized in that the upper machine part is mounted in a sliding way with regard to the lower machine part, namely in the feeding direction of the sheet-metal.

5. The sheet-metal bending machine according to claim 1, characterized in that the lower pair of working tools, consisting of the bending arm and the holding arm, is, located in relation to the upper machine part, mounted in a horizontally sliding way in the feeding direction of the sheet-metal.

6. The sheet-metal bending machine according to claim 1, characterized in that the upper machine part and the lower machine part are designed for mutual separation at least in the contact area of their working tools.

7. The sheet-metal bending machine according to claim 6, characterized in that the mechanism of mutual separation of the upper and lower machine part of the sheet-metal bending machine is equipped with a drive system containing a hydraulic motor.

8. The sheet-metal bending machine according to claim 7, characterized in that the adaptation for the mutual separation of the upper machine part and the lower machine part is designed in such a way that the upper machine part is mounted in a swinging way with regard to the lower machine part.

9. The sheet-metal bending machine according to claim 8, characterized in that the swinging way between the upper machine part and the lower machine part is designed in such a way that the upper machine part is mounted with regard to the lower machine part with the horizontal turning axis lying on the holding plane of the sheet metal.

10. The sheet-metal bending machine according to claim 9, characterized in that the upper machine part, rotationally mounted with regard to the lower machine part, has this mounting adapted to achieve an opening angle $\alpha$ between the upper machine part and the lower machine part of at least 30°.

11. The sheet-metal bending machine according to claim 10, characterized in that the upper machine part, rotationally mounted with regard to the lower machine part, has this mounting adapted to achieve the opening angle between the upper machine part and the lower machine part in the range from 60° to 90°.

12. The sheet-metal bending machine according to claim 10, characterized in that the mounting is adapted to achieve the opening angle $\alpha$ between the upper machine part and the lower machine part in the range from 70° to 80°.

13. The sheet-metal bending machine according to claim 6, characterized in that the mutual separation of the upper machine part and the lower machine part is designed in such a way that the upper machine part is mounted in a vertical sliding way with regard to the lower machine part in parallel guiding.

14. The sheet-metal bending machine according to claim 13, characterized in that the upper machine part, mounted in a vertically sliding way with regard to the lower machine part, has this mounting adapted to achieve an opening width between the upper machine part and the lower machine part of at least 200 mm.

15. The sheet-metal bending machine according to claim 13, characterized in that the upper machine part, mounted in a vertically sliding way with regard to the lower machine part, has this mounting adapted to achieve the opening width between the upper machine part and the lower machine part in the range from 500 to 1200 mm.

16. The sheet-metal bending machine according to claim 15, characterized in that the sliding mounting is designed to achieve the opening width between the upper machine part and the lower machine part in the range from 500 to 1000 mm.

17. The sheet-metal bending machine according to claim 1, characterized in that both the bending arms are connected to the corresponding holding arm with the use of the articulated movement mechanism.

18. The sheet-metal bending machine according to claim 17, characterized in that the movement mechanisms of the bending arms is driven by a hydraulic motor.

19. The sheet-metal bending machine according to claim 18, characterized in that the connection of at least one of the bending arms to the corresponding holding arm with the use of the articulated movement mechanism is adapted in such a way that, in the situation of holding clamping, the angle between the clamping plane and the front side of the bending arm is higher than 115°.

20. The sheet-metal bending machine according to claim 19, characterized in that, in the situation of holding clamping, the angle between the clamping plane and the front side of the bending arm is in the range from 125° to 150°.

21. A method of operation of the sheet-metal bending machine, according to claim 1, wherein the sheet-metal is clamped between the holding arm of the upper machine part or the lower machine part and the opposite bending arm of the opposite machine part, whereby the opposite bending arm is fixed, and a part of the sheet-metal exceeding a bending edge is subsequently bent, characterized in that the bending is done with the use of the bending arm suspended via the articulated movement mechanism on the holding arm such that the bending arm turns around a straight line lying near the bending edge of the sheet metal, whereby during the bending of the sheet-metal by the bending arm of the upper machine part the opposite fixed bending arm is represented by the bending arm of the lower machine part and during the bending of the sheet-metal by the bending arm of the lower machine part the opposite fixed bending arm is represented by the bending arm of the upper machine part.

* * * * *